United States Patent [19]

Saito

[11] Patent Number: 4,917,984

[45] Date of Patent: Apr. 17, 1990

[54] ELECTROPHOTOGRAPHIC TONER COMPOSITION COMPRISING POLYMERS HAVING SPECIFIED MOLECULAR WEIGHTS

[75] Inventor: Jun Saito, Kawasaki, Japan

[73] Assignee: Nippon Zeon Co., Ltd., Tokyo, Japan

[21] Appl. No.: 230,530

[22] Filed: Aug. 10, 1988

[30] Foreign Application Priority Data

Mar. 10, 1987 [JP] Japan ..... 62-198181

[51] Int. Cl.[4] ..... G03G 9/08

[52] U.S. Cl. ..... 430/109; 430/904

[58] Field of Search ..... 430/109, 904

[56] References Cited

U.S. PATENT DOCUMENTS

| | | | |
|---|---|---|---|
| 3,640,861 | 2/1972 | Hsia | 430/109 |
| 3,964,903 | 6/1976 | Van Besauw et al. | 430/109 X |
| 4,246,332 | 1/1981 | Tanaka et al. | 430/109 |

FOREIGN PATENT DOCUMENTS

| | | |
|---|---|---|
| 259819 | 3/1988 | European Pat. Off. . |
| 2159824 | 12/1985 | United Kingdom . |

*Primary Examiner*—J. David Welsh

*Attorney, Agent, or Firm*—Sherman and Shalloway

[57] ABSTRACT

An electrophotographic toner composition consisting essentially of a binder resin and a dye or pigment, said binder resin being a polymer synthesized from a vinylic monomer and satisfying the conditions represented by the following expressions $$10^3 \leqq Mp \leqq 2 \times 10^4,$$

and $$S_1:S_2:S_3:S_4=(0.3\sim0.8):1:(0.5\sim1):(0.7\sim1.2)$$

in which the symbols have the following meanings in the molecular weight distribution of the polymer measured by gel permeation chromatography, Mp is a molecular weight of the polymer which shows a peak value in the chromatogram, $S_1$ is a weight fraction of molecules having a molecular weight of from 0 to 3,000, $S_2$ is a weight fraction of molecules having a molecular weight of from more than 3,000 to 13,000, $S_3$ is a weight fraction of molecules having a molecular weight of from more than 13,000 to 50,000, and $S_4$ is a weight fraction of molecules having a molecular weight of more than 50,000.

4 Claims, No Drawings

ELECTROPHOTOGRAPHIC TONER COMPOSITION COMPRISING POLYMERS HAVING SPECIFIED MOLECULAR WEIGHTS

This invention relates to a toner for developing a latent electrostatic image in electrophotography, and particularly to an electrophotographic toner which gives copies having excellent resistance to backgrounding after fixation by hot rollers.

In electrophotography, a hot roller fixing method by which a toner image transferred to a receptor sheet is passed between hot rollers under pressure to fix the image on the sheet is widely used because it permits rapid fixation. A toner used in the hot roller fixing method should meet various requirements, among which are:

it should be easily melted by heating;

it should have a low fixation temperature to reduce thermal consumption during fixation; and it should not undergo an offset phenomenon whereby a part of the toner adheres to the surface of the hot fixing rollers and is transferred to the next sheet.

In addition, since copied prints have recently gained widespread use and been in use more frequently, the backgrounding resistance of the toner which is the freedom from staining of the sheet surface during repeated use has become an important property. In other words, the toner fixed to the sheet surface should not be separated by frictional movement of the sheet surface to contaminate the sheet surface.

It is an object of this invention to provide an electrophotographic toner having excellent backgrounding resistance in copies.

We have now found that the backgrounding resistance has closely to do with the molecular weight of a vinylic polymer used as a toner binder.

Thus, according to this invention, there is provided an electrophotographic toner composition consisting essentially of a binder resin and a dye or pigment, said binder resin being a polymer synthesized from a vinylic monomer and satisfying the conditions represented by the following expressions $$10^3 \leqq Mp \leqq 2\times10^4,$$

and $$S_1:S_2:S_3:S_4=(0.3\sim0.8):1:(0.5\sim1):(0.7\sim1.2)$$

in which the symbols have the following meanings in the molecular weight distribution of the polymer measured by gel permeation chromatography, Mp is a molecular weight of the polymer which shows a peak value in the chromatogram, $S_1$ is a weight fraction of molecules having a molecular weight of from 0 to 3,000, $S_2$ is a weight fraction of molecules having a molecular weight of from more than 3,000 to 13,000, $S_3$ is a weight fraction of molecules having a molecular weight of from more than 13,000 to 50,000, and $S_4$ is a weight fraction of molecules having a molecular weight of more than 50,000.

The toner composition of this invention comprises essentially of a binder resin and a dye or pigment, and may optionally contain adjuvants for fortifying the properties of the composition as a toner and various additives.

The thermoplastic polymer used in the toner composition of this invention can be prepared by polymerizing at least one vinylic monomer by a known method. Preferably, the thermoplastic polymer is a styrene copolymer. Examples of the vinylic monomer include styrenes such as styrene, alpha-methylstyrene and p-chlorostyrene; acrylic monomers such as acrylic acid, methyl acrylate, ethyl acrylate, butyl acrylate, dodecyl acrylate, octyl acrylate and phenyl acrylate: methacrylic monomers such as methacrylic acid, methyl methacrylate, ethyl methacrylate, butyl methacrylate and octyl methacrylate; acrylonitrile, methacrylonitrile and acrylamide; maleic acid monomers such as maleic acid, maleic anhydride, methyl maleate and dimethyl maleate; vinyl esters such as vinyl acetate and vinyl benzoate; vinyl ketones such as vinyl chloride, vinyl methyl ketone and vinyl ethyl ketone; vinyl ethers such as vinyl methyl ether, vinyl ethyl ether and vinyl isobutyl ether; and dienes such as butadiene and isoprene.

According to this invention, a toner having a low fixation temperature, good offset resistance and excellent backgrounding resistance can be provided by using as the binder resin the above polymer or its mixture which in its molecular weight distribution measured by gel permeation chromatograhy, meets the conditions represented by the following expression $$10^3 \leqq Mp \leqq 2\times10^4,$$

and $$S_1:S_2:S_3:S_4=(0.3\sim0.8):1:(0.5\sim1):(0.7\sim1.2)$$

in which the symbols have the following meanings in the molecular weight distribution of the polymer measured by gel permeation chromatography, Mp is a molecular weight of the polymer which shows a peak value in the chromatogram, $S_1$ is a weight fraction of molecules having a molecular weight of from 0 to 3,000, $S_2$ is a weight fraction of molecules having a molecular weight of from more than 3,000 to 13,000, $S_3$ is a weight fraction of molecules having a molecular weight of from more than 13,000 to 50,000, and $S_4$ is a weight fraction of molecules having a molecular weight of more than 50,000.

The fixation temperature is affected by the molecular weight Mp which shows a peak value, the weight fraction $S_1$ of the low-molecular-weight portion, the weight fraction $S_3$ of the intermediate-molecular-weight portion and the weight fraction $S_4$ of the high-molecular-weight portion. When $Mp>2\times10^4$, and/or $S_1<0.3$ and/or $S_3>1$ and/or $S_4>1.2$, the fixation temperature undesirably becomes high. The preferred Mp is $3\times10^3 \leqq Mp \leqq 1.5\times10^4$.

The offset resistance of the toner composition is affected by the weight fraction $S_4$ of the highmolecular-weight portion. When $S_4<0.7$, the offset temperature becomes low.

The backgrounding resistance is affected by the molecular weight Mp which shows a peak value, the weight fraction $S_1$ of the low-molecular-weight portion and the weight fraction $S_3$ of the intermediate-molecular-weight portion. When $Mp<10^3$ and/or $S_1>0.8$ and/or $S_3<0.5$, the backgrounding resistance becomes poor.

The dye or pigment used in this invention may be selected as desired. Examples are carbon black, iron black, ultramarine, phthalocyanine blue, quinacridone, benzidine yellow, nigrosine dyes and azo dyes.

In the case of a two-component toner, a certain required amount of glass spheres or an iron powder, for example, is incorporated as a carrier for the toner. In a magnetic toner, a ferromagnetic metal, or an alloy or compound containing it is incorporated as a magnetic powder.

Furthermore, a toner is formed by adding a low-molecular-weight olefinic polymer or copolymer, low-molecular-weight polyethylene, low-molecular-weight polypropylene or hydrophobic silica as a material which improves dispersibility of the toner and its adhesion to a sheet surface without adversely affecting a cleaning member, etc. of a copying machine.

A developer for an electrostatic copying machine can be obtained by melt-mixing the above ingredients of the toner, pulverizing the mixture, classifying the pulverized mixture, and optionally surface-treating the product with hydrophobic silica, and adding required amounts of glass spheres, iron power, etc. are incorporated in required amounts as the carrier.

According to this invention, there can be provided a toner composition having increased offset resistant temperature and improved backgrounding resistance while maintaining a low fixing roll temperature as a result of adjusting the molecular weight distribution of the thermoplastic binder resin so as to meet specific conditions. Copies produced by using the toner composition of this invention in an electrostatic copying machine can be used repeatedly over an extended period of time, and their storage life is prolonged.

The following examples illustrate the present invention more specifically. Unless otherwise specified, all parts and percentages in Examples and Comparative Examples are on a weight basis.

The properties of the toners are summarized in Table 1.

The backgrounding resistance was evaluated as follows.

Backgrounding, as used in this invention, denotes a phenomenon in which a copied sheet is frictionally moved under application of pressure, the fixed toner is separated to contaminate the background of the copy.

The copy sheet was fixed to a frictional tester (JIS-L-0823) for testing fastness characteristics of dyeings with the copied surface upside. A white cotton cloth was fixed to a frictional member and the copied surface was rubbed with the frictional member by moving it through five reciprocations. Contamination around the copied image was observed, and the backgrounding resistance of the copy was evaluated visually, and rated on a scale of three grades (good, fair and poor).

EXAMPLE 1

Forty-five parts of a styrene/2-ethylhexyl acrylate copolymer [styrene/2-ethylhexyl acrylate weight ratio 90/10; number average molecular weight (Mn) 3,900; weight average molecular weight (Mw) 12,100], 25 parts of a styrene/2-ethylhexyl acrylate copolymer (styrene/2-ethylhexyl acrylate weight ratio 90/10; Mn 19,700, Mw 65,000), 30 parts of a styrene/2-ethylhexyl acrylate 90/10; Mn 283,000 Mw 877,000), 8 parts of carbon black (Cabot BPL, a tradename for a product of Cabot Ltd.), a metal-containing dye (Spilon Black TRH, a tradename for a product of Hodogaya Chemical Co., Ltd.) and 4 parts of low-molecular-weight polypropylene (Viscol 550P, a tradename for a product of Sanyo Chemical Industries, Ltd.) were melt-kneaded by two rolls, crushed by a jet mill, and classified by air to give a toner material having a number average particle diameter of 12 micrometers and containing less than 10% of fine particles having a size of less than 5 micrometers. Hyrdophobic silica (0.3 part) was added to 100 parts of the toner material and they were mixed by a Henschel mixer to give a toner.

The toner was dissolved in tetrahydrofuran. The insoluble portion was separated by filtration, and its molecular weight distribution was measured by gel permeation chromatography (GPC for short). The results were as follows:

Mp: 4,300
$S_1$: 14%
$S_2$: 31%
$S_3$: 24%
$S_4$: 31%
$S_1:S_2:S_3:S_4=0.45:1:0.77:1$

Five parts of the toner and 95 parts of a carrier (TEFV150/250, a tradenamefor a product of Nippon Teppun K. K.) were mixed by a ball mill to prepare a developer.

The developer was charged into a commercial copying machine. Copies were produced by the machine and evaluated.

EXAMPLE 2

Forty-two parts of a styrene/butyl acrylate copolymer (styrene/butyl acrylate ratio 92/8; Mn 3,400; Mw 10,800), 28 parts of a styrene/butyl acrylate copolymer (styrene/butyl acrylate ratio 92/8; Mn 12,900; Mw 45,100), 30 parts of a styrene/butyl acrylate copolymer (styrene/butyl acrylate ratio 92/8; Mn 201,000; Mw 723,000), 8 parts of carbon black (Cabot BPL), 1 part of a metal-containing dye (Spilon Black TRH) and 4 parts of low-molecular-weight polypropylene (Viscol 550P) were melt-kneaded by two rolls, crushed by a jet mill and classified by air to give a toner material having a number average particle diameter of 12 micrometers and containing less that 10% of fine particles having a size of less than 5 micrometers. Hydrophobic silica (0.3 part) was added to 100 parts of the toner material, and they were mixed by a Henschel mixer to give a toner.

The toner was dissolved in tetrahydrofuran. The insoluble portion was separted by filtration and its molecular weight distribution was measured by GPC. The results were as follows:

Mp: 4,000
$S_1$: 16%
$S_2$: 29%
$S_3$: 23%
$S_4$: 32%
$S_1:S_2:S_3:S_4=0.55:1:0.79:1.10$

Five parts of the toner and 95 parts of a carrier (TEFV150/250) were mixed by a ball mill to prepare a developer.

The developer was charged into a commercial copying machine. Copies were produced by the machine and evaluated.

EXAMPLE 3

Twenty-five parts of a styrene/butyl acrylate copolymer (styrene/butyl acrylate ratio 85/15; Mn 6,000; Mw 15,000), 40 parts of a styrene/butyl acrylate copolymer (styrene/butyl acrylate ratio 85/15; Mn 16,000; Mw 48,000), 35 parts of a styrene/butyl acrylate copolymer (styrene/butyl acrylate ratio 85/15; Mn 260,000; Mw 750,000), 8 parts of carbon black (Cabot BPL), 1 part of a metal-containing dye (Spilon Black TRH) and 4 parts of low-molecular-weight polypropylene (Viscol 550P) were melt-kneaded by two rolls, crushed by a jet mill and classified by air to give a toner material having a number average particle diameter of 12 micrometers and containing less than 10% of fine particles having a size of less than 5 micrometers. Hydrophobic silica (0.3 part) was added to 100 parts of the toner material, and they were mixed by a Henschel mixer to give a toner.

The toner was dissolved in tetrahydrofuran. The insoluble portion was separated by filtration and its molecular weight distribution was measured by GPC. The results were as follows:

Mp: 13,000
$S_1$: 13%
$S_2$: 33%
$S_2$: 30%
$S_3$: 24%
$S_4$: 24%
$S_1:S_2:S_3:S_4=0.39:1:0.91:0.73$

Five parts of the toner and 95 parts of a carrier (TEFV150/250) were mixed by a ball mill to prepare a developer.

The developer was charged into a commercial copying machine. Copies were produced by the machine and evaluated.

COMPARATIVE EXAMPLE 1

Thirty parts of a styrene/butyl acrylate copolymer (styrene/butyl acrylate ratio 83/17; Mn 8,200; Mw 32,000), 40 parts of a styrene/butyl acrylate copolymer (styrene/butyl acrylate ratio 83/17; Mn 29,000; Mw 72,000), 30 parts of a styrene/butyl acrylate copolymer (styrene/butyl acrylate ratio 83/17; Mn 201,000; Mw 723,000), 8 parts of carbon black (Cabot BPL), 1 part of a metal-containing dye (Spilon Black TRH) and 4 parts of low-molecular-weight polypropylene (Viscol 550P) were melt-kneaded by two rolls, crushed by a jet mill and classified by air to give a toner material having a number average particle diameter of 12 micrometers and containing less than 10% of fine particles having a size of less than 5 micrometers. Hydrophobic silica (0.3 part) was added to 100 parts of the toner material, and they were mixed by a Henschel mixer to give a toner.

The toner was dissolved in tetrahydrofuran. The insoluble portion was separated by filtration and its molecular weight distribution was measured by GPC. The results were as follows:

Mp: 24,000
$S_1$: 30%
$S_2$: 9%
$S_3$: 29%
$S_4$: 32%
$S_1:S_2:S_3:S_4=0.30:1:0.97:1.07$

Five parts of the toner and 95 parts of a carrier (TEFV150/250) were mixed by a ball mill to prepare a developer.

The developer was charged into a commercial copying machine. Copies were produced by the machine and evaluated.

COMPARATIVE EXAMPLE 2

Sixty-five parts of a styrene/2-ethylhexyl acrylate copolymer (styrene/2-ethylhexyl acrylate weight ratio 90/10; Mn 3,900; Mw 12,100), 35 parts of a styrene/2-ethylhexyl acrylate copolymer (styrene/2ethylhexyl acrylate weight ratio 90/10; Mn 283,000; Mw 877,000), 8 parts of carbon black (Cabot BPL), a metal-containing dye (Spilon Black TRH), and 4 parts of low-molecular-weight polypropylene (Viscol 550P), were melt-kneaded by two rolls, crushed by a jet mill, and classified by air to give a toner material having a number average particle diameter of 12 micrometers and containing less than 10% of fine particles having a size of less than 5 micrometers. Hydrophobic silica (0.3 part) was added to 100 parts of the toner material and they were mixed by a Henschel mixer to give a toner.

The toner was dissolved in tetrahydrofuran. The insoluble portion was separated by filtration, and its molecular weight distribution was measured by GPC. The results were as follows:

Mp: 4,200
$S_1$: 26%
$S_2$: 37%
$S_3$: 4%
$S_4$: 33%
$S_1:S_2:S_3:S_4=0.70:1:0.11:0.89$

Five parts of the toner and 95 parts of a carrier (TEFV150/250) were mixed by a ball mill to prepare a developer.

The developer was charged into a commercial copying machine. Copies were produced by the machine and evaluated.

COMPARATIVE EXAMPLE 3

Forty parts of a styrene/2-ethylhxyl acrylate copolymer (styrene/2-ethylhexyl acrylate ratio 90/10; Mn 3,900; Mw 12,100), 35 parts of a styrene/2-ethylhexyl acrylate copolymer (styrene/2-ethylhexyl acrylate ratio 90/10; Mn 19,700; Mw 65,000), 25 parts of a styrene/2-ethylhexyl acrylate (styrene/2-ethylhexyl acrylate ratio 90/10; Mn 283,000; Mw 877,000), 8 parts of carbon black (Cabot BPL), 1 part of a metal-containing dye (Spilon Black TRH) and 4 parts of low-molecular-weight polypropylene (Viscol 550P) were melt-kneaded by two rolls, crushed by a jet mill, and classified by air to give a toner material having a number average particle diameter of 12 mcirometers and containing less than 10% of fine particles having a size of less than 5 micrometers. Hydrophobic silica (0.3 part) was added to 100 parts of the toner material and they were mixed by a Henschel mixer to give a toner.

The toner was dissolved in tetrahydrofuran. The insoluble portion was separated by filtration, and its molecular weight distribution was measured by GPC. The results were as follows:

Mp: 4,500
$S_1$: 14%
$S_2$: 28%
$S_3$: 33%
$S_4$: 25%
$S_1:S_2:S_3:S_4=0.50:1:1.18:0.89$

Five parts of the toner and 95 parts of a carrier (TEFV150/250) were mixed by a ball mill to prepare a developer.

The developer was charged into a commercial copying machine. Copies were produced by the machine and evaluated.

COMPARATIVE EXAMPLE 4

Sixty parts of a styrene/butyl acrylate copolymer (styrene/butyl acrylate ratio 92/8; Mn 6,500; Mw 20,800), 40 parts of a styrene/butyl acrylate copolymer (styrene/butyl acrylate ratio 92/8; Mn 201,000; Mw 723,000), 8 parts of carbon black (Cabot BPL), 1 part of a metal-containing dye (Spilon Black TRH) and 4 parts of low-molecular-weight polypropylene (Viscol 550P) were melt-kneaded by two rolls, crushed by a jet mill and classified by air to give a toner material having a number average particle diameter of 12 micrometers and containing less than 10% of fine particles having a size of less than 5 micrometers. Hydrophobic silica (0.3 part) was added to 100 parts of the toner material, and they were mixed by a Henschel mixer to give a toner.

The toner was dissolved in tetrahydrofuran. The insoluble portion was separated by filtration and its molecular weight distribution was measured by GPC. The results were as follows:

Mp: 6,500
$S_1$: 8%
$S_2$: 38%
$S_3$: 19%
$S_4$: 35%
$S_1:S_2:S_3:S_4=0.21:1:0.50:0.92$

Five parts of the toner and 95 parts of a carrier (TEFV150/250) were mixed by a ball mill to prepare a developer.

The developer was charged into a commercial copying machine. Copies were produced by the machine and evaluated.

COMPARATIVE EXAMPLE 5

Seventy parts of a styrene/2-ethylhexyl acrylate copolymer (styrene/2-ethylhexyl acrylate weight ratio 90/10; Mn 3,900; Mw 12,100), 20 parts of a styrene/2-ethylhexyl acrylate copolymer (styrene/2-ethylhexyl acrylate weight ratio 90/10; Mn 19,700, Mw 65,000), 10 parts of a styrene/2-ethylhexyl acrylate 90/10; Mn 283,000 Mw 877,000), 8 parts of carbon black (Cabot BPL), a metal-containing dye (Spilon Black TRH) and 4 parts of low-molecular-weight polypropylene (Viscol 550P) were melt-kneaded by two rolls, crushed by a jet mill, and classified by air to give a toner material having a number average particle diameter of 12 micrometers and containing less than 10% of fine particles having a size of less than 5 micrometers. Hydrophobic silica (0.3 part) was added to 100 parts of the toner material and they were mixed by a Henschel mixer to give a toner.

The toner was dissolved in tetrahydrofuran. The insoluble portion was separated by filtration, and its molecular weight distribution was measured by GPC. The results were as follows:

Mp: 4,300
$S_1$: 32%
$S_2$: 36%
$S_3$: 17%
$S_4$: 15%
$S_1:S_2:S_3:S_4=0.89:1:0.47:0.42$

Five parts of the toner and 95 parts of a carrier (TEFV150/250) were mixed by a ball mill to prepare a developer.

The developer was charged into a commercial copying machine. Copies were produced by the machine and evaluated.

COMPARATIVE EXAMPLE 6

Forty-five parts of a styrene/2-ethylhexyl acrylate copolymer (styrene/2-ethylhexyl acrylate weight ratio 90/10; Mn 3,900; Mw 12,100), 20 parts of a styrene/2-ethylhexyl acrylate copolymer (styrene/2-ethylhexyl acrylate weight ratio 90/10; Mn 19,700, Mw 65,000), 35 parts of a styrene/2-ethylhexyl acrylate 90/10; Mn 283,000 Mw 877,000), 8 parts of carbon black (Cabot BPL), a metal-containing dye (Spilon Black TRH), and 4 parts of low-molecular-weight polypropylene (Viscol 550P) were melt-kneaded by two rolls, curshed by a jet mill, and classified by air to give a toner material having a number average particle diameter of 12 micrometers and containing less than 10% of fine particles having a size of less than 5 micrometers. Hydrophobic silica (0.3 parts) was added to 100 parts of the toner material and they were mixed by a Henschel mixer to give a toner.

The toner was dissolved in tetrahydrofuran. The insoluble portion was separated by filtration, and its molecular weight distribution was measured by GPC. The results were as follows:

Mp: 4,300
$S_1$: 18%
$S_2$: 29%
$S_3$: 15%
$S_4$: 38%
$S_1:S_2:S_3:S_4=0.62:1:0.51:1.31$

Five parts of the toner and 95 parts of a carrier (TEFV150/250) were mixed by a ball mill to prepare a developer.

The developer was charged into a commercial copying machine. Copies were produced by the machine and evaluated.

The results obtained in the foregoing examples are summarized in Table 1.

TABLE 1

| | | Mp | Weight ratio $S_1$ | $S_2$ | $S_3$ | $S_4$ | Fixation temperature (°C.) | Offset temperature (°C.) | Back-grounding resistance |
|---|---|---|---|---|---|---|---|---|---|
| Example | 1 | 4,700 | 0.45 | 1 | 0.77 | 1 | 150 | 240 | Good |
| | 2 | 4,000 | 0.55 | 1 | 0.79 | 1.10 | 150 | 240 | Good |
| | 3 | 13,000 | 0.39 | 1 | 0.91 | 0.73 | 150 | 240 | Good |
| Comparative | 1 | 24,000 | 0.30 | 1 | 0.97 | 1.07 | 180 | 240 | Good |
| Example | 2 | 4,200 | 0.70 | 1 | 0.11 | 0.89 | 160 | 240 | Poor |
| | 3 | 4,500 | 0.50 | 1 | 1.18 | 0.89 | 180 | 240 | Fair |
| | 4 | 6,500 | 0.21 | 1 | 0.50 | 0.92 | 180 | 240 | Poor |
| | 5 | 4,300 | 0.89 | 1 | 0.47 | 0.42 | 150 | 200 | Poor |
| | 6 | 4,300 | 0.62 | 1 | 0.51 | 1.31 | 180 | 240 | Fair |

We claim:

1. An electrophotograhic toner composition consisting essentially of a binder resin and a dye or pigment, said binder resin being a polymer synthesized from a vinylic monomer and satisfying the conditions represented by the following expressions $$10^3 \leqq Mp \leqq 2\times 10^4,$$

and $$S_1:S_2:S_3:S_4=(0.3\sim 0.8):1:(0.5\sim 1):(0.7\sim 1.2)$$

in which the symbols have the following meanings in the molecular weight distribution of the polymer measured by gel permeation chromatogrpahy, Mp is a molecular weight of the polymer which shows a peak value in the chromatogram, $S_1$ is a weight fraction of molecules having a molecular weight of from 0 to 3,000, $S_2$ is a weight fraction of molecules having a molecular weight of from more than 3,000 to 13,000, $S_3$ is a weight fraction of molecules having a molecular weight of from more than 13,000 to 50,000, and $S_4$ is a weight fraction of molecules having a molecular weight of more than 50,000.

2. The composition of claim 1 in which the binder resin is a styrene copolymer.

3. The composition of claim 1 in which the dye or pigment is carbon black, iron black, ultramarine, phthalocyanine blue, quinacridone, benzidine yellow, a nigrosine dye or an azo dye.

4. The composition of claim 1 which further comprises a low-molecular-weight olefinic polymer or copolymer, and/or hydrophobic silica.

* * * * *

UNITED STATES PATENT AND TRADEMARK OFFICE

CERTIFICATE OF CORRECTION

PATENT NO. : 4,917,984

DATED : April 17, 1990

INVENTOR(S) : JUN SAITO

It is certified that error appears in the above-identified patent and that said Letters Patent is hereby corrected as shown below:

On the cover page, under "Foreign Application Priority Data", "Mar. 10 1987" should read --Aug. 10 1987--.

Claim 1, line 11 of the claim, "chromatogrpahy" should read --chromatography--.

Signed and Sealed this

Sixteenth Day of July, 1991

*Attest:*

*Attesting Officer*

HARRY F. MANBECK, JR.

*Commissioner of Patents and Trademarks*